US005819642A

United States Patent [19]

Stuchl

[11] Patent Number: 5,819,642

[45] Date of Patent: Oct. 13, 1998

[54] BRANCH BUNDLER

[76] Inventor: Ronald J. Stuchl, 1705 Park Dr., Schaumburg, Ill. 60194

[21] Appl. No.: 845,860

[22] Filed: Apr. 28, 1997

[51] Int. Cl.[6] ..... B65B 27/10

[52] U.S. Cl. ..... 100/8; 56/342; 100/212

[58] Field of Search ..... 100/1, 8, 34, 212; 56/342; 294/55

[56] References Cited

U.S. PATENT DOCUMENTS

| | | | |
|---|---|---|---|
| 21,540 | 9/1858 | Sherwood | 100/212 |
| 246,890 | 9/1881 | Lamb | 56/342 |
| 542,363 | 7/1895 | Graham et al. | 100/212 |
| 3,742,842 | 7/1973 | Pierens | 100/212 |
| 5,289,765 | 3/1994 | Gray | 100/212 |

FOREIGN PATENT DOCUMENTS

| | | | |
|---|---|---|---|
| 39517 | 11/1909 | Austria | 100/212 |

*Primary Examiner*—Stephen F. Gerrity

[57] ABSTRACT

A branch or other similar article bundler including a central rod, a skid at its forward end and a handle assembly at its proximal end. The handle assembly has a forward molded hand grip coaxial with the rod and a rear twine spool for dispensing twine around a guide in the skid and the guided twine is cleated back on the handle assembly. The bundler with twine looped through the skid guide and cleated back to the handle assembly is slid under the branch pile, the twine end is then uncleated and wrapped forwardly around the branches and tied off adjacent the forward skid guide.

11 Claims, 3 Drawing Sheets

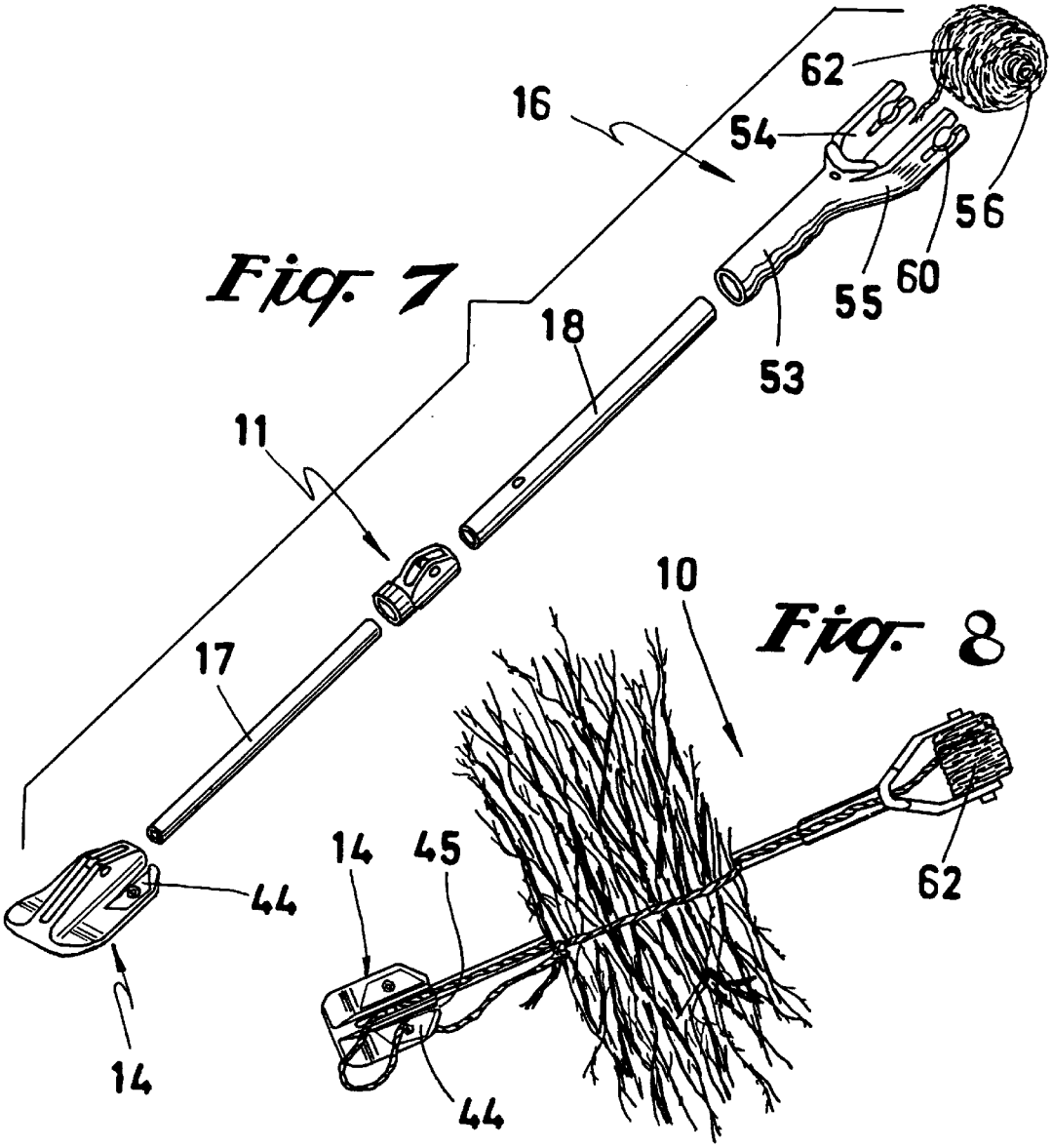
Fig. 7
Fig. 8
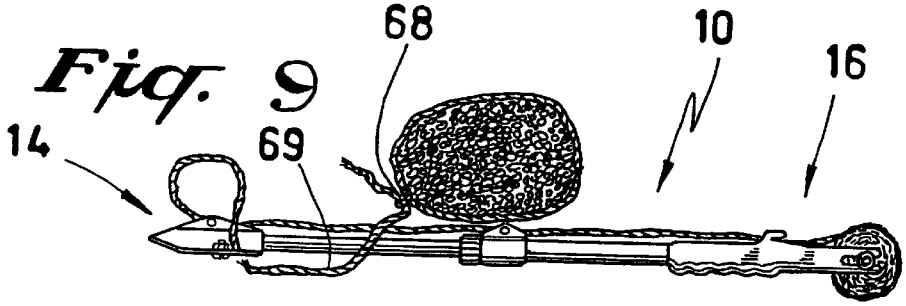
Fig. 9

BRANCH BUNDLER

BACKGROUND OF THE INVENTION

Many present day municipalities require branches be twined and curbed or the refuse department by ordinance must not pick-up. And of course there is a more general need that branches, clippings and dead fall be bundled for ease of pick-up and transport.

It is quite surprising given these needs that an efficient, low-cost and easy to use system for branch bundling has to this date gone unaccomplished.

While efficient systems have been devised for shock bundling, tree trunk roping, and ground bundling that is binding with the material on the ground, small branch bundling, with the exception of the manual method of laying the branches in a pile over the twine, has been limited to a rack type device that requires the branches to be placed in a stationary frame that is really not suitable for easy movement around the yard area, particularly in large grounds.

The following patents are representative of the prior art in this field which includes tying or roping objects other than small branches that may or may not be relevant to the present invention:

UNITED STATES PATENTS

| Inventor | U.S. Pat. No. | Issue Date |
|---|---|---|
| Thomas | 511,917 | January 2, 1894 |
| Wisman | 1,285,535 | November 19, 1918 |
| Archer | 2,850,315 | September 2, 1958 |
| Davis | 4,495,862 | January 29, 1985 |
| Gainey | 4,572,559 | February 25, 1986 |
| Gray | 5,289,765 | March 1, 1994 |

The Wisman, U.S. Pat. No. 1,285,535, dated in November of 1918, discloses a shock binding means that includes a hardwood bar 1 having slots at both ends for retaining both the baling twine 15, as well as a heavy cord 4 that constitutes with the pulley assembly 11, a means for compressing the shock while the user ties the binding or tying twine 15 around the shock.

Wisman suggests that the bar 1 is designed to slide under the shock before binding.

The Archer, U.S. Pat. No. 2,850,315, issued in September of 1958, shows a Log Choker Guide, which is essentially a handle-driven U-shaped shovel that holds and guides a cable 13 under a heavy log, and this device is particularly designed for the logging industry.

The Davis, U.S. Pat. No. 4,495,862, having issued in January of 1985, discloses a Limb Bundler and Bag Holder for binding branches into bundles. The Davis device essentially is an upstanding rack into which the branches must be placed in preparation for bundling.

The Gray, U.S. Pat. No. 5,289,765, issued in March of 1994, shows a Flexible Plastic Device for Binding and Toting Tree Trimmings, but not for ground bundling.

As seen in FIG. 1, the portable hand tool 15 includes a handle 23 and a lower slidable cord 41 having a connector 43 that is releasably attached to a retainer 27 formed as part of the hand tool 15. The holder rope 41 is designed to compress the branch bundle, while twine 12 from dispenser 61 is wrapped around to permanently bind the bundle. The handle 23 can be used to transport the bundle to a different location. More importantly, it does not appear that this device can be utilized to slide the binding twine 12 under the bundle.

The Thomas Baling Machine for Trees, as shown in U.S. Pat. No. 511,917, issued in January, 1894, appears fairly relevant at first glance but when one reads the patent, it is clear that the trees must be placed in the binding position so the device is really not utilized to slide binding twine under the trees to be baled.

It is a primary object of the present invention to ameliorate the problems presented in the prior art of material bundling to provide an efficient, complete and easy to use system for bundling small branches as they lay piled on the ground.

SUMMARY OF THE PRESENT INVENTION

In accordance with the present invention, a complete system is provided for bundling multiple piles of small branches or other similar articles on the ground in an efficient, easy to use and low cost manner.

Toward these ends, the present branch bundler includes a central rod, a skid at its forward end and a handle assembly at its proximal end. The handle assembly has a forward molded hand grip coaxial with the rod and a rear twine spool for dispensing twine around a guide in the skid and the guided twine is cleated back on the handle assembly. The bundler with twine looped through the skid guide and cleated back to the handle assembly is slid under the branch pile, the twine end is then uncleated and wrapped forwardly around the branches and tied off adjacent the forward skid guide.

The skid is generally planar and has a rearwardly opening recess that forms a cutting slot without creating a branch snagging problem. A flat cutting blade is mounted co-planar along the recess to minimize accidental finger cutting that enables the user to cut the twine close to where the bundle tie-off occurs.

The user withdraws the twine from the spool and feeds it through the skid guide back to the handle assembly cleat. After grasping the handle, the forward skid is slid under the bundle, the twine end is then uncleated and wrapped forwardly over the top of the branch bundle tying the bundle off near the skid. The twine outside the tie-off is severed at the skid mounted cutting blade.

This bundler can also be used to bundle other articles, such as pine trees, for bundling and shipping.

Other objects and advantages will appear more clearly from the following detailed description of the invention.

BRIEF DESCRIPTION OF THE DRAWINGS

FIG. 7 is an exploded view showing the basic parts of the present branch bundler, and;

FIGS. 8 and 9 illustrate the manner of using the branch bundler to tie off and bundle a pile of branches.

DETAILED DESCRIPTION OF THE PREFERRED EMBODIMENT

Figure 1:
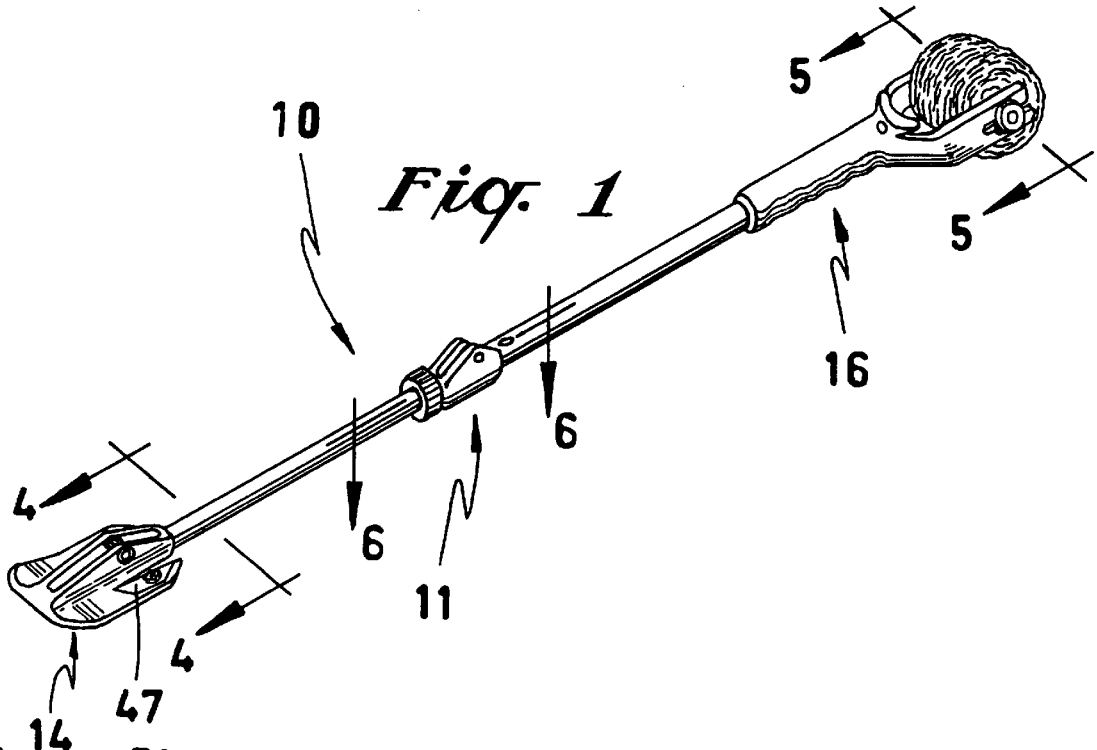
FIG. 1 is a perspective view of the present branch bundler extended with the twine wound.
Figure 2:
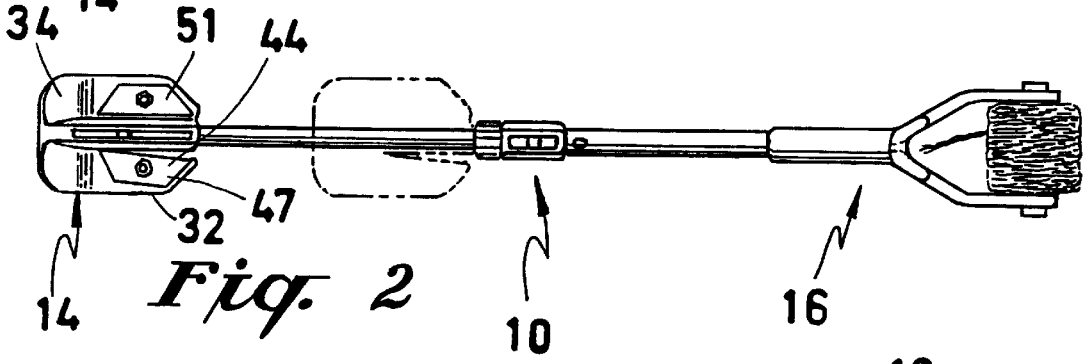
FIG. 2 is a top view of the branch bundler shown in FIG. 1 with the skid shown retracted in phantom.
Figure 3:
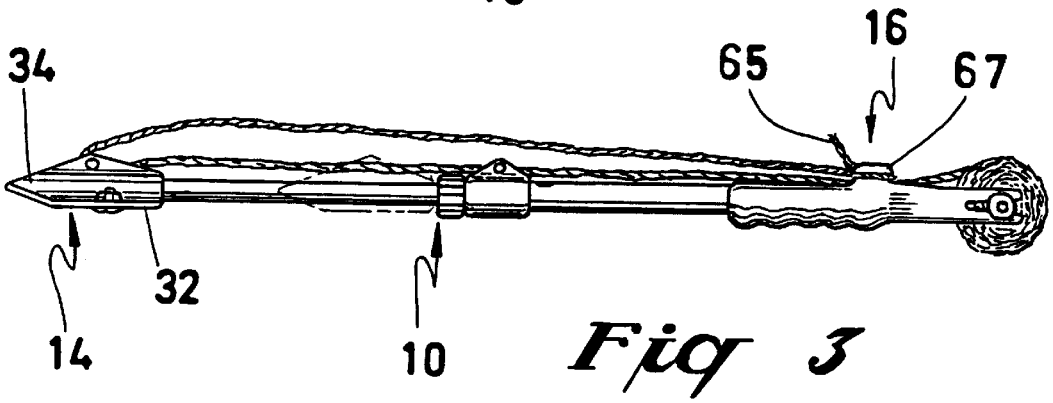
FIG. 3 is a left side view of the branch bundler shown in FIGS. 1 and 2, with the twine cleated in its ready position.
Figure 4:
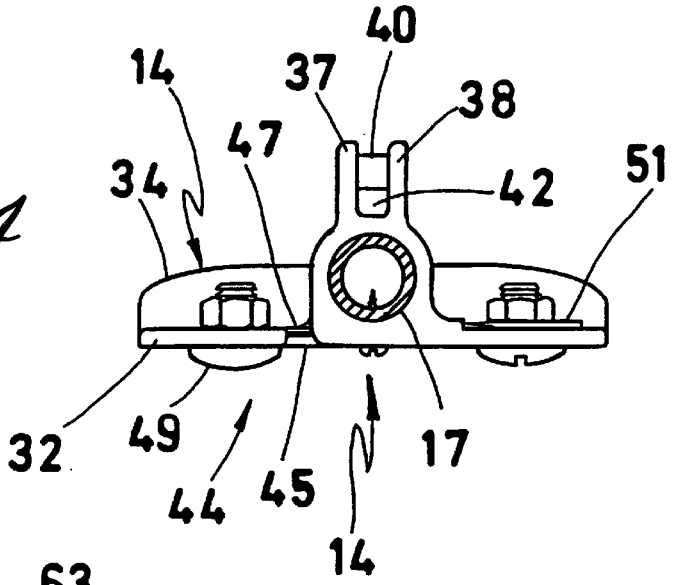
FIG. 4 is a cross-section taken along line 4—4 of FIG. 1 showing the rear end of the skid.
Figure 5:
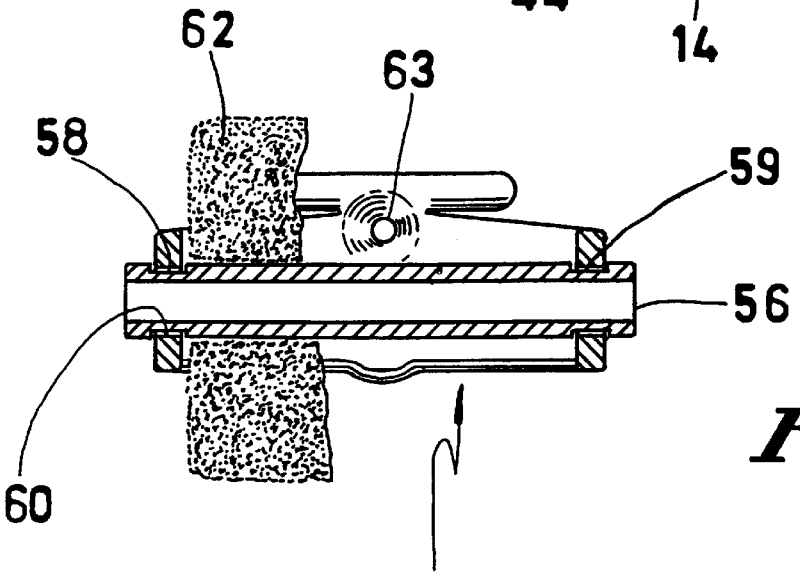
FIG. 5 is a fragmented cross-section taken along line 5—5 of FIG. 1 showing the twine spool.
Figure 6:
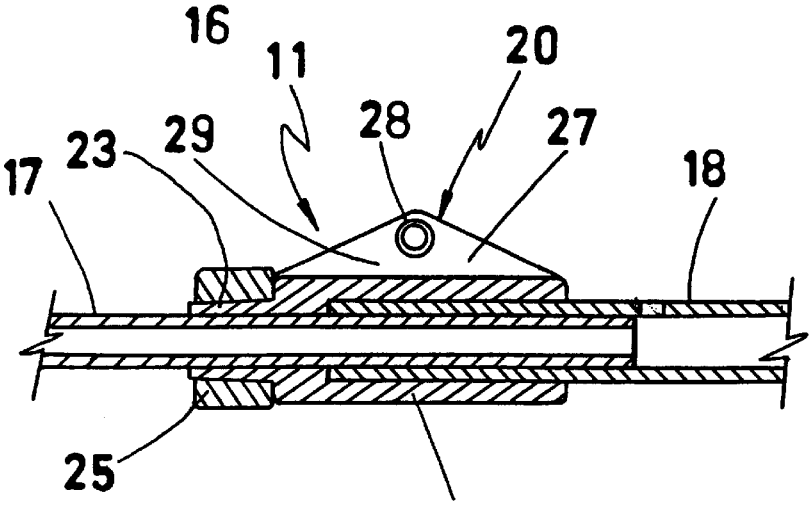
FIG. 6 is a fragmented longitudinal cross-section taken generally along line 6—6 of FIG. 1 showing the telescopic lock.

The present branch bundler is intended for use in residential and commercial landscape clean-up, and while similar binding devices have been devised, they are peculiar to other types of work. For example, the Archer, U.S. Pat. No. 2,850,315 discussed above is intended to drive a shovel or trough like head under a fallen heavy tree trunk and to do that, the head is designed to dig under the ground beneath the tree. Contrary to that purpose, the present branch bundler and particularly its forward skid is configured to slip under the branch pile by gliding over the ground surface.

Viewing the drawings, the branch bundler 10 is seen to generally include a central collapsible rod assembly 11, a forward or distal one-piece plastic molded skid 14, and a rear or proximal handle assembly 16.

The central section includes inner tube 17 that selectively collapses inside outer tube 18 both constructed of flexible tubing of fiberglass, aluminum or other suitable material. The tubes 17 and 18 are selectively locked in any relative position by an annular lock assembly 20 that includes an annular body 22 having a tapered forward projection 23 that is axially split and receives a similarly tapered locking ring 25.

The lock assembly is released and engaged by rotating and axially moving the locking ring 25 thereof clamping or unclamping the tapered projection 23 against the inner tube 17. Of course, the body 22 is fixed over the end of the outer tube 18.

Body 22 has spaced upward flanges 27 with forward and rear ramp surfaces that are non-snagging, connected by a twine guide tube 28 that forms a twine "eye" 29 through which the twine is threaded.

The forward skid 14 is a one-piece plastic molding with a flat planar portion 32 and an upwardly curved forward skid portion 34 that prevents the skid from digging into the ground and also to scoop the lower branches in the branch pile. The skid has a pair of upwardly projecting flanges 37 and 38 spaced from one another, and both have forward and rear anti-snagging ramps. Guide tube 40 interconnects the flanges 37 and 38 and forms a second "eye" 42 for looping the twine back to the handle assembly 16.

The skid 14 has a cutting assembly 44 for cutting the twine at the forward end of the bundles including a rearwardly opening "V" shaped recess 45 that is anti-branch snagging. A trapezoidal cutting blade 47 is mounted in a shallow recess in planar portion 32 and has a cutting edge that extends into the recess 45 and is clamped by fastener 49.

A back up blade 51 is also mounted on planar skid portion 32.

The handle assembly 16 includes a one-piece plastic molding having a forward annular hand grip portion 53 that fits over and is bonded to the end of tube 18, and rearwardly extending spaced leg portions 54 and 55 that rearwardly receive twine spool 56. Twine spool 56 has annular recesses 58 and 59 that slide into locking recess 60 in the leg portions 54 an 55, that permit the spool and its wrapped twine 62 to rotate.

Handle assembly 16 has a guide bore 63 through which twine end 65 is threaded initially from the spool 62. The end is then threaded through eye 29 and through eye 42 and back to cleat 67 in preparation for bundling.

Viewing FIGS. 8 and 9, the user, holding handle portion 53, slides the skid 14 under the branch pile, uncleats twine end 65 and wraps it tightly over the pile, tying the pile off at its forward end about at point 68. The other end 69 of the bundled twine is then cut off at the cutting assembly 44, and the bundled branches are ready for pick-up.

I claim:

1. A branch bundler for small branch pieces and cuttings, comprising: an elongated rod having a forward end and a proximal end designed to form a central portion of the branch bundler, a skid on the forward end of the rod having a lower surface with means to skid over the ground and an upper surface with means to slide under branches without snagging the branches, said skid being smooth and planar with an uninterrupted forward surface to minimize snagging branches as it slides under the branches, a handle assembly at the proximal end of the rod including an annular handle portion and a spool portion for holding a ball of twine, means on the skid for receiving the twine from the handle assembly guide, whereby the user slides the bundler under the branches with the twine received in the skid and then wraps and ties the twine around the branches to form a bundle.

2. A branch bundler for small branch pieces and cuttings as defined in claim 1, wherein the skid has a lower surface with means to slide under the branches as the skid is slid under the branches.

3. A branch bundler for small branch pieces and cuttings, comprising: an elongated rod having a forward end and a proximal end designed to form a central portion of the branch bundler, a skid on the forward end of the rod having a lower surface with means to skid over the ground and an upper surface with means to slide under branches without snagging the branches, a handle assembly at the proximal end of the rod including an annular handle portion and a spool portion for holding a ball of twine, a guide on the skid for slidably receiving the twine and directing it back to the handle assembly, and cleat means on the handle assembly to which the twine end from the skid is tied, whereby the user slides the bundler under the branches with the twine looped through the skid guide and tied to the cleat, unties the twine end from the cleat and wraps the end forwardly over the branches and ties it to the twine adjacent the skid guide.

4. A branch bundler for small branch pieces and cuttings as defined in claim 3, including a cutter on the skid for cutting the twine adjacent the skid guide.

5. A branch bundle for small branch pieces and cuttings as defined in claim 4, wherein the skid has a horizontally planar portion having a rearwardly opening recess so it does not snag branches as the skid is slid under the branches, said cutter being a flat blade attached to the skid planar portion adjacent the recess and lying in the same plane as the planar portion to form a safety for the cutter.

6. A branch bundler for small branch pieces and cuttings as defined in claim 3, wherein the handle assembly handle portion extends axially and is at the forward end of the assembly coaxial with the rod.

7. A branch bundler for small branch pieces and cuttings as defined in claim 6, wherein the twine spool portion is at the rear of the handle assembly and is transverse to the axis of the handle portion.

8. A branch bundler for small branch pieces and cuttings as defined in claim 3, wherein the rod is tubular and formed with telescoping pieces selectively locked together by a twist lock mechanism.

9. A branch bundler for small branch pieces and cuttings, comprising: an elongated rod having a forward end and a proximal end designed to form a central portion of the branch bundler, a skid on the forward end of the rod having a lower surface with means to skid over the ground and an upper surface with means to slide under branches without snagging the branches, a handle assembly at the proximal end of the rod including an annular handle portion and a spool portion for holding a ball of twine, said handle assembly including a guide for guiding the twine toward the skid, a guide on the skid for slidably receiving the twine and directing it back to the handle assembly, cleat means on the handle assembly to which the twine end from the skid is tied, whereby the user slides the bundler under the branches with the twine looped through the skid guide and tied to the bundle cleat, unties the twine end from the cleat and wraps the end forwardly over the branches and ties it to the twine adjacent the skid guide, and a cutter on the skid for cutting the twine adjacent the skid guide, said cutter being a flat blade attached to the skid planar portion adjacent the recess and lying in the same plane as the planar portion to form a safety for the cutter, the handle assembly handle portion extending axially and being at the forward end of the assembly coaxial with the rod, and the twine spool portion being at the rear of the handle assembly and being transverse to the axes of the handle portion.

10. A branch bundler for small branch pieces and cuttings, comprising: an elongated rod having a forward end and a proximal end designed to form a central portion of the branch bundler, handle means on the rod, means on the rod for holding twine to be utilized for bundling the branch pieces and cuttings, a skid on the forward end of the rod having a lower surface with means to skid over the ground without digging and an upper surface with means to slide under branches without snagging the branches, said handle means being at the proximal end of the rod and including an annular handle portion, said means to slide under the branches without snagging including a horizontal planar portion on the skid and a forward wide upwardly curved integral portion for scooping the bundler under the branches, whereby the user slides the bundler under the branches and then wraps and ties the twine around the branches to form a bundle.

11. A branch bundler for small branch pieces and cuttings as defined in claim 10, wherein the skid includes a twine eye for looping the twine back to the handle portion so the twine can be tied off near the skid after the twine end is brought forwardly over the branches.

* * * * *